US011255097B2

(12) United States Patent
Bikker

(10) Patent No.: US 11,255,097 B2
(45) Date of Patent: Feb. 22, 2022

(54) TRANSPORTABLE SANITARY UNIT

(71) Applicant: MAD INVESTMENTS BV, Sliedrecht (NL)

(72) Inventor: Marcel Adriaan Dirk Bikker, Sliedrecht (NL)

(73) Assignee: MAD INVESTMENTS BV, Sliedrecht (NL)

( * ) Notice: Subject to any disclaimer, the term of this patent is extended or adjusted under 35 U.S.C. 154(b) by 0 days.

(21) Appl. No.: 16/772,531

(22) PCT Filed: Dec. 13, 2018

(86) PCT No.: PCT/NL2018/050837
§ 371 (c)(1),
(2) Date: Jun. 12, 2020

(87) PCT Pub. No.: WO2019/117720
PCT Pub. Date: Jun. 20, 2019

(65) Prior Publication Data

US 2020/0386006 A1 Dec. 10, 2020

(30) Foreign Application Priority Data

Dec. 14, 2017 (NL) ..... 2020090

(51) Int. Cl.
*E04H 1/12* (2006.01)
*A47K 11/02* (2006.01)

(52) U.S. Cl.
CPC ..... *E04H 1/1216* (2013.01); *A47K 11/02* (2013.01)

(58) Field of Classification Search
CPC ..... E04H 41/1216; A47K 11/02
See application file for complete search history.

(56) References Cited

U.S. PATENT DOCUMENTS 2,188,213 A 1/1940 Wilson
2,538,736 A 1/1951 Spencer
(Continued)

FOREIGN PATENT DOCUMENTS

CN 101812862 8/2010
DE 2063109 7/1971
(Continued)

OTHER PUBLICATIONS

Dutch Search Report, dated Oct. 23, 2012, from corresponding Dutch application.
(Continued)

*Primary Examiner* — Janie M Loeppke
(74) *Attorney, Agent, or Firm* — Nixon & Vanderhye

(57) ABSTRACT

Transportable sanitary unit, comprising a frame and a number of sanitary facilities supported by the frame, wherein the frame comprises an upper section and a lower section, wherein the upper section comprises an upper cover and upper column sections extending downward from the upper cover and the lower section comprises a bottom and lower column sections extending upward from the bottom, wherein the upper section and the lower section can be moved relative to each other between an upwardly extended operational position having an operational height and a downwardly retracted transport position having a transport height that is lower than the operational height, wherein the upper column sections and the lower column sections can be slid into or along each other over a slide path, between the operational position and the transport position, and in the operational position can be secured one to the other in that position using blocking means, wherein the upper cover and the bottom comprise construction members, such as girders and carriers,
(Continued)

providing the upper cover and the bottom with a construction height, which each time defines a vertical space, wherein in the transport position the lower column sections extend to within the vertical space of the upper cover and/or the upper column sections extend to within the vertical space of the bottom.

20 Claims, 7 Drawing Sheets

(56) References Cited

U.S. PATENT DOCUMENTS

| | | | |
|---|---|---|---|
| 2,611,134 | A | 9/1952 | Jarrett et al. |
| 2,817,846 | A | 12/1957 | Stift |
| 2,827,004 | A | 3/1958 | Luce |
| 2,862,253 | A | 12/1958 | Place |
| 2,944,852 | A | 7/1960 | Snyder |
| 3,005,205 | A | 10/1961 | Breen |
| 3,494,655 | A | 2/1970 | Linton |
| 3,540,173 | A | 11/1970 | Johnides |
| 3,668,710 | A | 6/1972 | Dowd |
| 3,835,600 | A | 9/1974 | Padula et al. |
| 4,064,570 | A | 12/1977 | Kim |
| 4,107,795 | A | 8/1978 | Carter et al. |
| 4,332,040 | A | 6/1982 | Palmer |
| 4,454,613 | A | 6/1984 | Palmer |
| 4,488,752 | A | 12/1984 | Broussard |
| 4,653,125 | A | 3/1987 | Porter |
| 5,379,466 | A | 1/1995 | Davies |
| 5,778,462 | A | 7/1998 | Bjorklund et al. |
| 5,832,676 | A | 11/1998 | Gillmore et al. |
| 5,964,065 | A | 10/1999 | Migurski et al. |
| 6,202,948 | B1 | 3/2001 | Kelly |
| 6,712,414 | B2 | 3/2004 | Morrow |
| 6,721,967 | B2 | 4/2004 | Braxton |
| 6,948,196 | B2 | 9/2005 | Hinton |
| 7,117,646 | B2 | 10/2006 | Blaisdell et al. |
| 7,137,156 | B2 | 11/2006 | Yang |
| 7,827,738 | B2 | 11/2010 | Abrams et al. |
| 7,882,577 | B2 | 2/2011 | Merz et al. |
| 8,091,157 | B2 * | 1/2012 | Tyler ..... E04H 1/1216 4/477 |
| 8,256,443 | B2 | 9/2012 | Neal |
| 8,291,647 | B2 | 10/2012 | Esposito |
| 9,060,652 | B2 | 6/2015 | Bikker |
| 9,067,721 | B2 | 6/2015 | Mullaney |
| 9,234,360 | B2 | 1/2016 | Van Overbeek |
| 9,260,189 | B2 | 2/2016 | Savian et al. |
| 9,296,554 | B2 | 3/2016 | Ferren |
| 9,328,498 | B2 | 5/2016 | Chen et al. |
| 9,334,105 | B2 | 5/2016 | Dinter et al. |
| 9,340,963 | B2 | 5/2016 | Ito et al. |
| 2002/0185889 | A1 | 12/2002 | Hernandez et al. |
| 2002/0194796 | A1 | 12/2002 | Kress |
| 2004/0040081 | A1 | 3/2004 | Ostbo |
| 2005/0284035 | A1 | 12/2005 | Deovando et al. |
| 2006/0201939 | A1 | 9/2006 | McPhee |
| 2007/0079573 | A1 | 4/2007 | Sarine et al. |
| 2008/0172953 | A1 | 7/2008 | Piorkowski |
| 2008/0209624 | A1 | 9/2008 | Lavoie et al. |
| 2008/0307714 | A1 | 12/2008 | Knoop |
| 2011/0252719 | A1 | 10/2011 | Wallance |
| 2012/0144576 | A1 | 6/2012 | Taylor et al. |
| 2016/0160515 | A1 | 6/2016 | Wallance |
| 2016/0298347 | A1 * | 10/2016 | Bikker ..... E04H 1/1216 |

FOREIGN PATENT DOCUMENTS

| | | |
|---|---|---|
| DE | 10021241 | 9/2000 |
| DE | 20312312 | 11/2003 |
| EP | 162397 | 11/1985 |
| EP | 1630307 | 3/2006 |
| EP | 2546169 | 1/2013 |
| EP | 2 657 414 | 10/2013 |
| WO | 87/07665 | 12/1987 |
| WO | 02/17764 | 3/2002 |
| WO | 02/103138 | 12/2002 |
| WO | 2007/041757 | 4/2007 |
| WO | 2008/089319 | 7/2008 |
| WO | 2010/018277 | 2/2010 |
| WO | 2011/110725 | 9/2011 |
| WO | 2013/095094 | 6/2013 |
| WO | 2017/074182 | 5/2017 |
| ZA | 200509633 | 10/2006 |

OTHER PUBLICATIONS

Chinese Office Action, dated Nov. 18, 2016, from corresponding Chinese Application No. CN 201380013531.8.

Notice of References Cited in U.S. Appl. No. 13/833,174 dated Nov. 22, 2013.

Notice of References Cited in U.S. Appl. No. 13/833,174 dated May 8, 2014.

Notice of References Cited in U.S. Appl. No. 13/833,174 dated Sep. 25, 2014.

Notice of References Cited in U.S. Appl. No. 13/833,174 dated Feb. 18, 2015.

Notice of References Cited in U.S. Appl. No. 14/714,692 dated Jun. 16, 2015.

Notice of References Cited in U.S. Appl. No. 14/714,692 dated Oct. 1, 2015.

Notice of References Cited in U.S. Appl. No. 14/714,692 dated Feb. 17, 2016.

Notice of References Cited in U.S. Appl. No. 15/180,967 dated Jul. 15, 2016.

Notice of References Cited in U.S. Appl. No. 15/180,967 dated Nov. 21, 2016.

* cited by examiner

TRANSPORTABLE SANITARY UNIT

BACKGROUND OF THE INVENTION

The invention relates to a transportable sanitary unit. Such a unit can be used to provide a location temporarily with sanitary equipment for individuals staying at that location. It may concern large crowds, such as in case of sports contests, music festivals and other events. It may also concern the provision of care in disaster areas, operational actions and exercises, facilities at industrial installations. The sanitary equipment will in general comprise sanitary facilities such as toilet bowls. It may also comprise sanitary facilities such as urinals, wash basins and/or showers.

It may concern sanitary arrangements of a considerable capacity, at large events the overall arrangement may comprise many dozens of sanitary units. The transport volume may in that case be considerable, having consequences for the costs of transport and logistics.

The transport efforts can be reduced if use is made of sanitary units which can be placed in a smaller transport position, as compared to the operational position, such as for instance known from U.S. Pat. Nos. 9,060,652, 9,366,019 and 9,605,424. Although considerable improvements can be achieved with them, there is a constant need for an even further reduction of the costs and efforts involved in transport.

SUMMARY OF THE INVENTION

According to one aspect, the invention provides a transportable sanitary unit, comprising a frame and a number of sanitary facilities supported by the frame, wherein the frame comprises an upper section and a lower section, wherein the upper section comprises an upper cover and upper column sections extending downward from the upper cover and the lower section comprises a bottom and lower column sections extending upward from the bottom, wherein the upper section and the lower section can be moved relative to each other between an upwardly extended operational position having an operational height and a downwardly retracted transport position having a transport height that is lower than the operational height, wherein the upper column sections and the lower column sections can be slid into or along each other over a slide path, between the operational position and the transport position, and in the operational position can be secured one to the other in that position using blocking means, wherein the upper cover and the bottom comprise construction members, such as girders and carriers, providing the upper cover and the bottom with a construction height, which each time defines a vertical space, wherein in the transport position the lower column sections extend to within the vertical space of the upper cover and/or the upper column sections extend to within the vertical space of the bottom.

That way a relatively long slide path can be realized and it becomes possible to provide the sanitary unit with a low height in the transport position while preserving a sufficient height in the operational position, in which both column sections still overlap each other over an overlap length in view of stability. In known retractable/extendable units the slide path remains situated below the upper cover and above the bottom. The low height may, for instance, make the sanitary unit suitable for efficient transport in a standard transport container, together with other sanitary units that are identical in terms of their frames.

The upper cover and the bottom each have an upper plane and a lower plane. In the transport position the upper end of the lower column sections can be situated above the lower plane of the upper cover and/or the lower end of the upper column sections below the upper plane of the bottom.

Preferably the length of the lower column sections equals the length of the upper column sections, in which way the height of the unit in transport position can be kept low.

In one embodiment, in the transport position the lower column sections extend to above half the height of the upper cover, in a further embodiment thereof to near the upper plane of the upper cover, in particular up to the upper side of the construction members of the upper cover. In one embodiment the upper column sections extend to above half the height of the lower cover, in a further embodiment thereof to near the lower plane of the bottom, in particular down to the lower side of the construction members of the bottom.

In one embodiment, in which the upper column sections and the lower column sections can be slid into each other between the operational position and the transport position, the upper column sections can be slid into the lower column sections.

The upper column sections can extend downward from the upper side of the construction members, at a short distance (due to a cover plate) from the upper plane of the upper cover. The lower column sections can extend upward from the lower plane of the (open) bottom.

In one embodiment the frame defines a straight parallelepiped-shape or box-shape, wherein the upper column sections and the lower column sections are situated near the corners of the frame. On the upper plane and on the lower plane, near the corners, sanitary units according to the invention can be provided with placement means for stacking, such as cams and accommodation holes suited to the cams, for stacking two or more identical sanitary units, wherein the placement means can be arranged on support plates, wherein the upper column sections and lower column sections are attached to the support plates.

The upper column sections and lower column sections can be situated offset relative to the placement means, so that the column sections can extend over an as large as possible length in the upper cover and in the bottom.

The upper column sections and the lower column sections can be tubular. The column sections into/out of which the other column sections can slid may have a rectangular, preferably square cross-section, wherein the other column sections to be slid in/out have a round, preferably circular cross-section.

The lower column sections can define a vertical through opening, that means open throughout, as a result of which water ending up in there can flow away and water accumulating in the columns can be counteracted. Optionally the upper column sections can be open throughout as well.

According to a further aspect that may be combined with the previous embodiments/aspects, the invention provides a transportable sanitary unit, comprising a frame and a number of sanitary facilities supported by the frame, wherein the frame comprises an upper section and a lower section, wherein the upper section comprises an upper cover and upper column sections extending downward from the upper cover and the lower section comprises a bottom and lower column sections extending upward from the bottom, wherein the upper section and the lower section can be moved relative to each other between an upwardly extended operational position having an operational height and a downwardly retracted transport position having a transport height that is lower than the operational height, wherein the upper column sections and the lower column sections can be slid into or along each other over a slide path, between the operational position and the transport position, and in the operational position can be secured one to the other in that position using blocking means, wherein the frame defines a straight parallelepiped-shape or box-shape, and wherein the upper column sections and the lower column sections are situated near the corners of the frame, wherein the unit has an access side and holding means for doors at said access side, wherein the lower column sections that are situated near the corners at the access side, are situated offset in a direction away from the access side relative to the front edge of the bottom situated at the access side. That way it is possible to arrange the holding means for a door, such as hinge pins to be attached to the upper cover and to the bottom, at a corner in front of the column sections at that location, as a result of which in horizontal direction parallel to the access side space is gained and the horizontal space required for a number of individual toilet spaces situated next to each other, can be kept within limits.

According to a further aspect that may be combined with the previous embodiments/aspects, the invention provides a transportable sanitary unit, comprising a frame and a number of sanitary facilities supported by the frame, wherein the frame comprises an upper section and a lower section, wherein the upper section comprises an upper cover and upper column sections extending downward from the upper cover and the lower section comprises a bottom and lower column sections extending upward from the bottom, wherein the upper section and the lower section can be moved relative to each other between an upwardly extended operational position having an operational height and a downwardly retracted transport position having a transport height that is lower than the operational height, wherein the upper column sections and the lower column sections can be slid into or along each other over a slide path, between the operational position and the transport position, and in the operational position can be secured one to the other in that position using blocking means, wherein the unit comprises a number of sanitary subspaces that are situated next to each other, wherein the unit has an access side and holding means for doors at said access side, wherein the subspaces are bounded by partition walls in horizontal directions in a direction away from the access side (rearward) and/or towards one lateral side and/or towards both lateral sides, wherein the partition walls are divided into an upper partition wall section attached to the upper section, and a lower partition wall section attached to the lower section, wherein the upper partition wall section, considered from the interior of the subspace in question, during the conversion from the transport position into the operational position and vice versa, can be slid vertically along the inner side of the lower partition wall section. That way no room needs to be kept free on the exterior of the partition wall for the upper partition wall section, leaving more room available for conduits and the like. Furthermore, when being used as a shower and when rinsing the subspaces clean, the shower water/rinse water will run along the inner side of the partition wall and not flow to the other side, the outside, where the water may have a negative effect on the equipment/fittings present there.

Preferably the upper partition wall section is divided in vertical direction into partition wall portions, wherein the upper partition wall portion, considered from the interior of the subspace in question, during the conversion from the transport position into the operational position and vice versa, can be slid vertically along the inner side of the partition wall portion of the upper partition wall section situated below it. That way the length over which the upper partition wall section has to be slid in, can be kept within limits. This may be advantageous if the sanitary facility in the subspaces is attached to the lower section, in particular to a lower partition wall section. The lower edge of the lowermost upper partition wall section can then remain above the location of attachment of the sanitary facility. The drain of a urinal or toilet bowl can then remain above the bottom.

The partition walls for a subspace can define a lying U-shape, having two sidewalls and one back wall, wherein the opening of the U-shape is situated at the access side. Alternatively, the partition walls for a subspace may define a lying L-shape, having one sidewall and a back wall.

According to a further aspect that may be combined with the previous embodiments/aspects, the invention provides a transportable sanitary unit, comprising a frame and a number of sanitary facilities supported by the frame, wherein the frame comprises an upper section and a lower section, wherein the upper section comprises an upper cover and upper column sections extending downward from the upper cover and the lower section comprises a bottom and lower column sections extending upward from the bottom, wherein the upper section and the lower section can be moved relative to each other between an upwardly extended operational position having an operational height and a downwardly retracted transport position having a transport height that is lower than the operational height, wherein the upper column sections and the lower column sections can be slid into or along each other over a slide path, between the operational position and the transport position, and in the operational position can be secured one to the other in that position using blocking means, wherein the unit comprises a number of sanitary subspaces that are situated next to each other, wherein the unit has an access side and holding means for doors at said access side, wherein the subspaces are bounded by partition walls in horizontal directions in a direction away from the access side and/or towards one lateral side and/or towards both lateral sides, wherein the partition walls can be divided into an upper partition wall section attached to the upper section, and a lower partition wall section attached to the lower section, wherein the partition walls are provided with attachment locations for at least one sanitary accessory, wherein at said attachment location a passage is arranged in the partition wall for maintenance of the sanitary accessory in question. That way the accessory, such as a toilet roll holder, a soap dispenser, a waste bin can be reached from the exterior of the subspace in question by staff. Maintenance will be made easier that way. This is particularly the case when the partition wall forms a back wall of the subspace, wherein the maintenance passage is arranged in the back wall, preferably in the lower partition wall section, if present.

The sanitary accessory can be positioned at the rear, and in that way not be an obstacle for a wall to be slid along the inner side.

The sanitary unit according to the invention may in a compact yet user-friendly manner comprise three subspaces with toilet bowls, which subspaces are situated next to each other and accessible from the same access side.

A sanitary unit according to the invention can have a height in transport position in the order of, though lower than half the internal height of a standard 40 ft high cube transport container.

A sanitary unit according to the invention can have a width in the transport position at the access side, in the order of, though smaller than one fifth of the internal length of a standard 40 ft high cube container.

A sanitary unit according to the invention can have a depth in the transport position at the transverse sides, in the order of, though smaller than half the internal width of a standard 40 ft high cube container.

It is possible then to transport a relatively large number of sanitary units according to the invention, having corresponding frames, in a standard transport container. In particular a 40 ft high cube container can be used for that purpose.

A sanitary unit according to the invention has need of few loose parts and can be erected quickly.

The aspects and measures described in this description and the claims of the application and/or shown in the drawings of this application may where possible also be used individually. Said individual aspects may be the subject of divisional patent applications relating thereto. This particularly applies to the measures and aspects that are described per se in the sub claims.

BRIEF DESCRIPTION OF THE DRAWINGS

The invention will be elucidated on the basis of an exemplary embodiment shown in the attached drawings, in which.

DETAILED DESCRIPTION OF THE DRAWINGS

The sanitary unit 1 shown in FIGS. 1A-E and 2A,B comprises a straight parallelepiped-shaped or box-shaped, vertically retractable/extendable frame 2, for instance having steel construction members, that is divided into an upper frame section 2*a* and a lower frame section 2*b*.

Figure 2A:
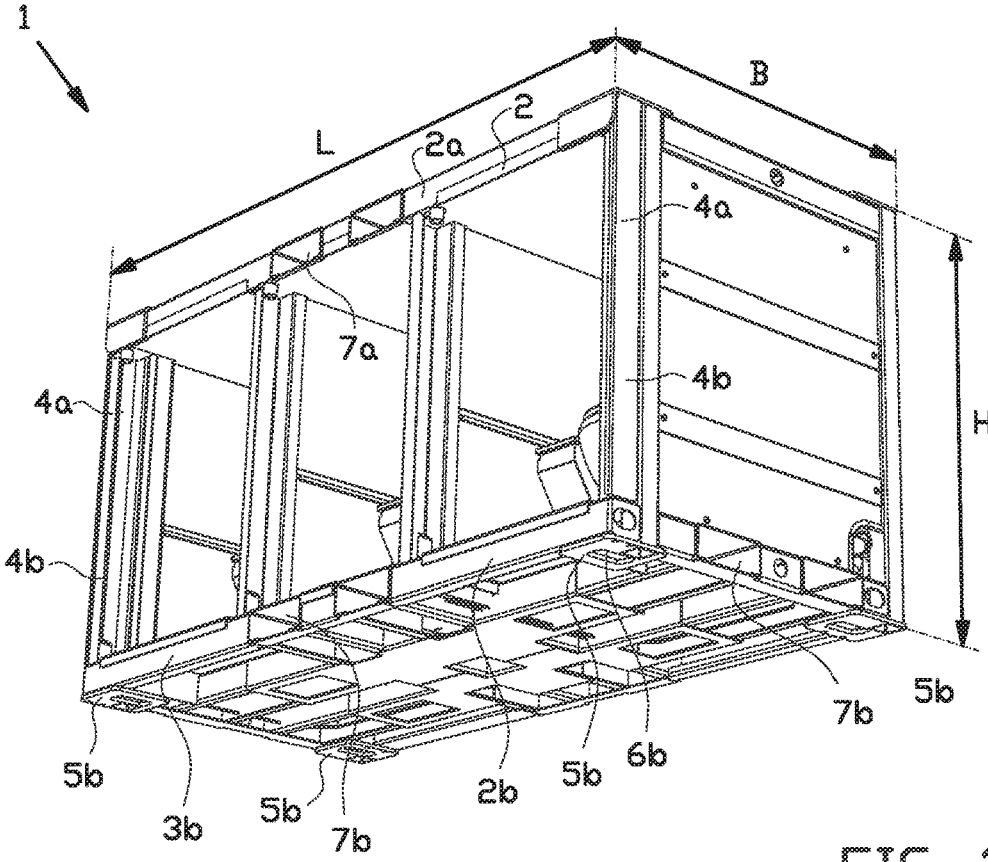
FIGS. 2A-B show views of the sanitary unit of FIGS. 1A-E, in the retracted transport position.
Figure 2B:
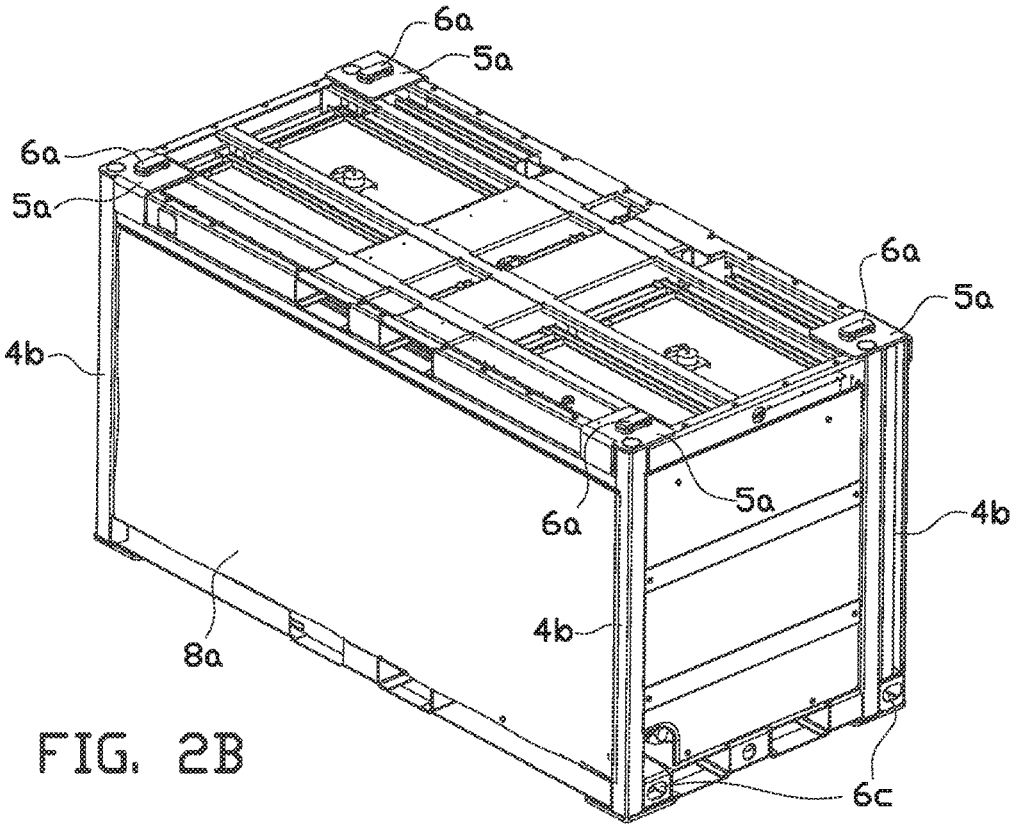

The upper frame section 2*a* comprises an upper cover 3*a* comprising a number of construction members in the form of tubular girders/carriers for providing strength and rigidity (see FIG. 2B) and is upwardly covered by an upper plate 20 (left out in FIG. 2B), the upper side of which defines an upper plane 3*aa*. Between their upper sides and lower sides, the construction members define a vertical space. Near the corners, hollow upper column sections 4*a*, having a circular cross-section, extend downward from the support plates 5*a* situated at the corners, to which support plates they are attached with their upper edges 4*aa*. The support plates 5*a* are provided with stacking cams 6*a*. The upper cover 3*a* further comprises fork holes 7*a* for lifting and lowering the upper frame section 2*a* using a forklift truck, which fork holes can be reached at the front side or access side and at the rear.

The lower frame section 2*b* comprises a bottom 3*b* comprising a number of construction members in the form of tubular girders/carriers for providing strength and rigidity and which is open in downward direction. Between their upper sides and lower sides, the construction members define a vertical space. Near the corners, hollow lower column sections 4*b*, having a square cross-section, extend upward from the support plates 5*b* situated at the corners, to which support plates they are attached with their lower edges 4*bb*. The support plates 5*b* are provided with holes 6*b* in which said stacking cams 6*a* fit. Inspection holes 6*c* make it possible to perceive such a fit. The bottom 3*b* further comprises fork holes 7*b* to all sides for moving the unit 1 using the fork of a forklift truck or pallet jack. At the lower side of the bottom 3*b*, the carriers/girders have holes for rollers of a pallet jack. The lower sides of the girders/carriers of the bottom 3*b* define a lower plane 3*bb*.

The column sections 4*a* and 4*b* have an identical length and form a vertical through passage that is open.

The lower frame section 2*b* further comprises a back plate 8*a* that can be flipped up and side plates 8*b*.

In the interior of the frame 2, three sanitary subspaces 9 that are situated next to each other are housed, equipped with toilet bowls P. The subspaces 9 are accessible at the front side and can be closed off by their own doors 10, in the operational position. At one vertical side, the doors 10 are bearing mounted so as to be rotatable on upper pivot pins 11*a* and lower pivot pins 11*b*, extending downward and upward, respectively, from the lower side of the upper cover 3*a* and the upper side of the bottom 3*b*. The fork holes 7*a*, 7*b* at the front side are situated just inside the sidewalls and the posts 19*a,b* (see below) of the middle subspace 9.

In this example, the subspaces 9 are each bounded laterally and rearward by a U-shaped partition wall 12, formed by an upper partition wall section 12*a* and a lower partition wall section 12*b*, which are attached to the upper frame section 2*a* and the lower frame section 2*b*, respectively, and which can be slid up and down along each other. The upper partition wall section 12*a* is divided itself as well into an upper partition wall portion 12*aa* and a lower partition wall portion 12*ab* that is connected thereto so as to be slidable therewith. The arrangement is such that the upper partition wall portion 12*aa* can be slid up and down just along and within the lower partition wall portion 12*ab*, and the lower partition wall portion 12*ab* can be slid up and down just along and within the lower partition wall section 12*b*. This can also be seen in FIG. 1D, in which a view from the interior towards the front side is shown. It also shows that the lower partition wall portions 12*ab* that are situated next to each other, are joined together and are slid up and down as one part or unity. When lowering the upper cover 3*a*, said cover will upon abutting the upper edge of the partition walls portions 12*ab* take them along downward. When lifting the upper cover 3*a* again, an abutment at the lower edge of the upper back wall portions 12*aa* will ensure that the partition wall portions 12*ab* are taken along.

The lower partition wall section 12*b* has a back wall portion 12*bb* to which the toiled bowl P as well as a waste bin 14 is attached. Behind the waste bin 14, the back wall portion 12*bb* is provided with a maintenance opening 16 for emptying the waste bin from the rear of the subspaces 9. Against the rear of the back wall portion 12*bb* a toilet roll holder is furthermore arranged, which is accessible to the user from the inside through opening 16 in back wall portion 12*bb* and accessible from the rear for replenishing the stock.

Behind the subspaces 9, a technical space 17 is realized within the frame 2, in particular within the lower frame section 2*b*, in which technical space there is room for the requisite drain pipes, water supply pipe(s) and electricity cables, optionally also for a pump and grinders for faeces and paper. The toilet bowls P have the drain in the back wall portion 12*bb*. In the transport position, the space 17 also provides room to the three doors 10. The space 17 can be shielded rearward by the said back plate 8*a* that can be flipped up.

The subspaces 9 further have a ceiling plate 18*a* and a floor plate 18*b*, which are attached in upper frame section 2*a* and lower frame section 2*b*, respectively. The floor plate 18*a* is slopes down towards the front side, for draining away rinse water.

For the protection of the front edges of the partition wall sections 12*a*, 12*b* and optionally the vertical articulation of the front edges of the upper partition wall sections 12*a*, vertical upper and lower profiles 19*a*, 19*b* have been attached to the front side of the upper frame section 2*a* and lower frame section 2*b*, respectively, wherein the profile section 19*a* can slide inside the profile section 19*b*.

Figure 1A:
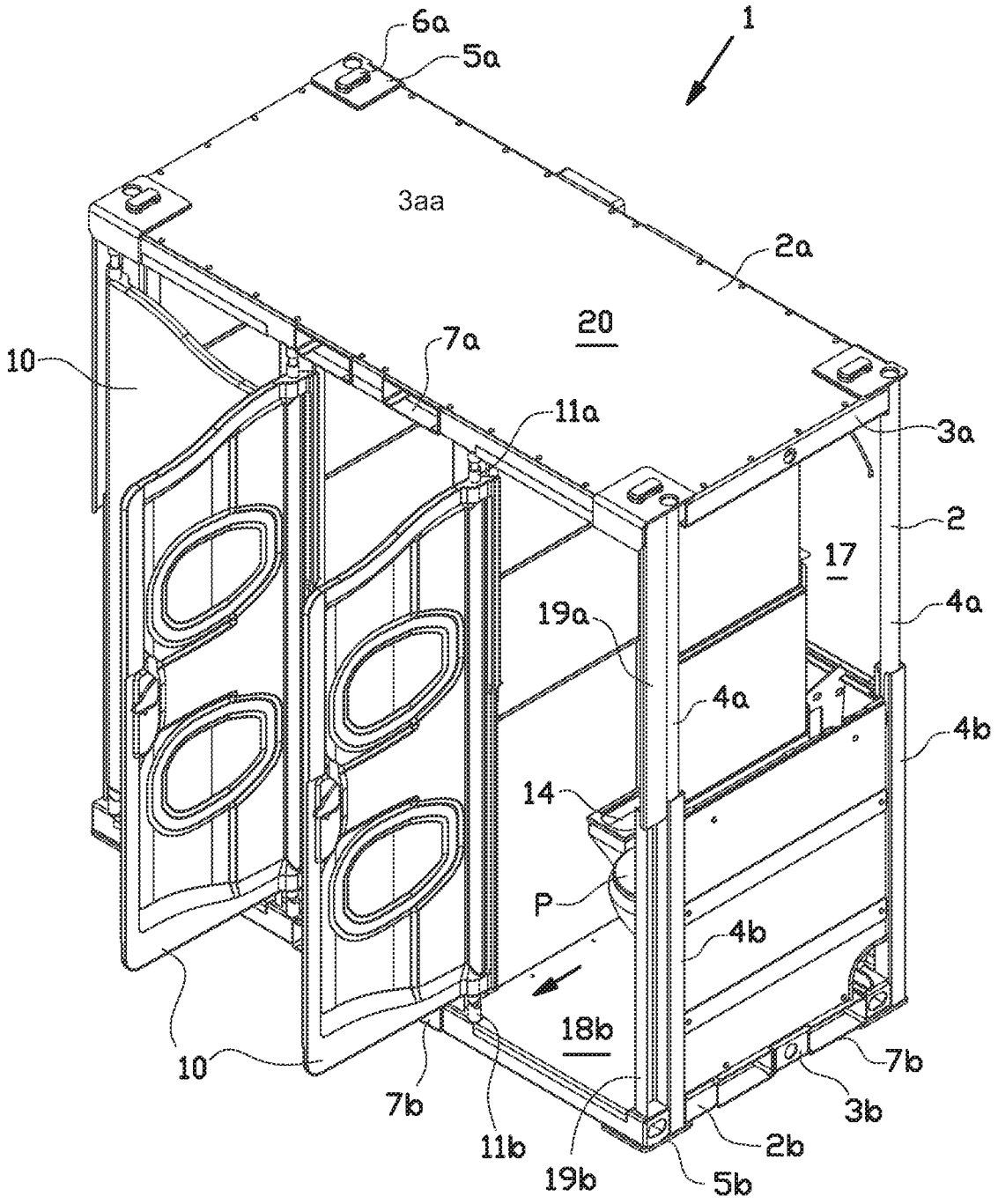
FIGS. 1A-E show a number of views of a sanitary unit according to the invention, in the extended operational position.
Figure 1B:
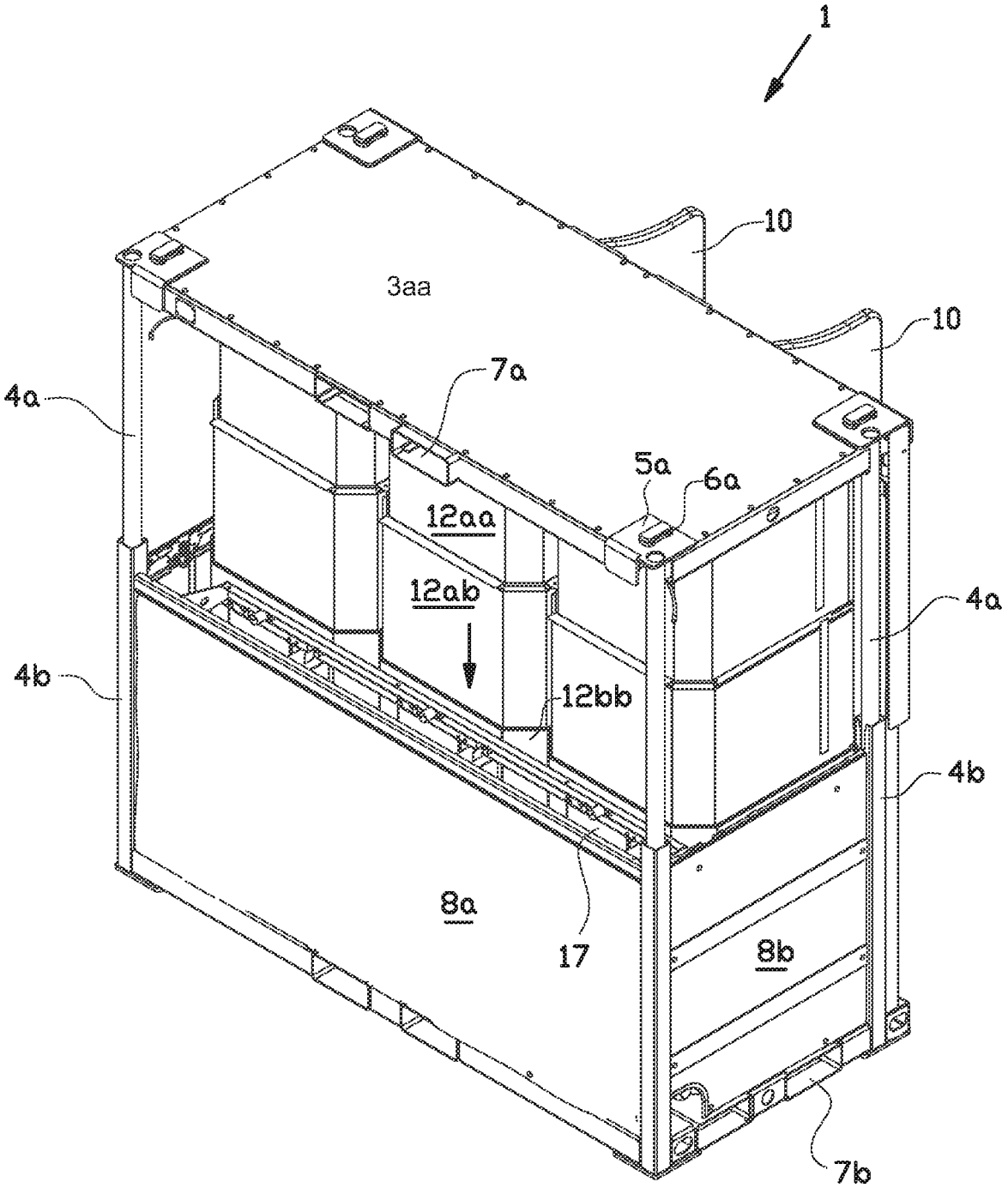
Figure 1C:
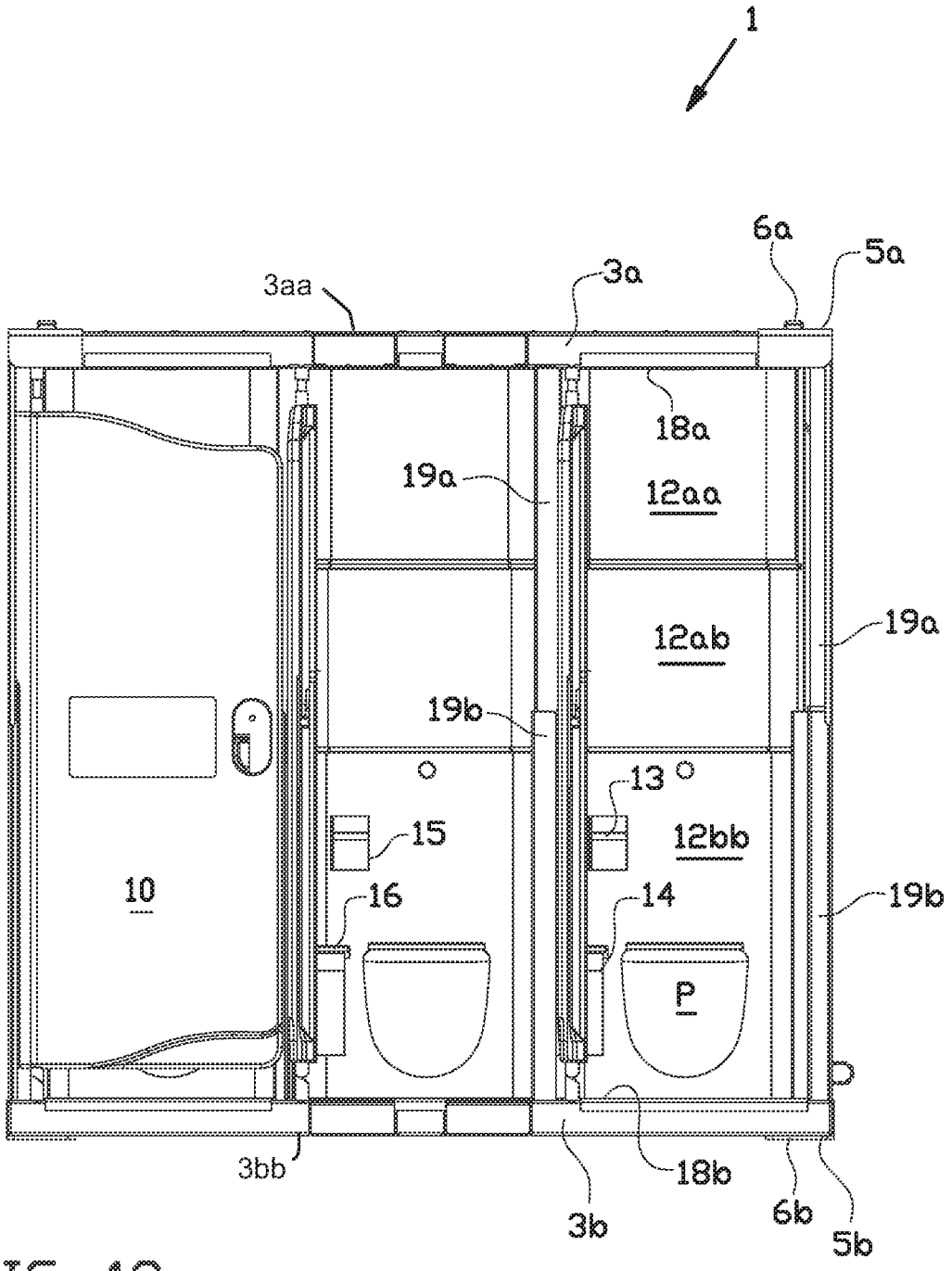
Figure 1D:
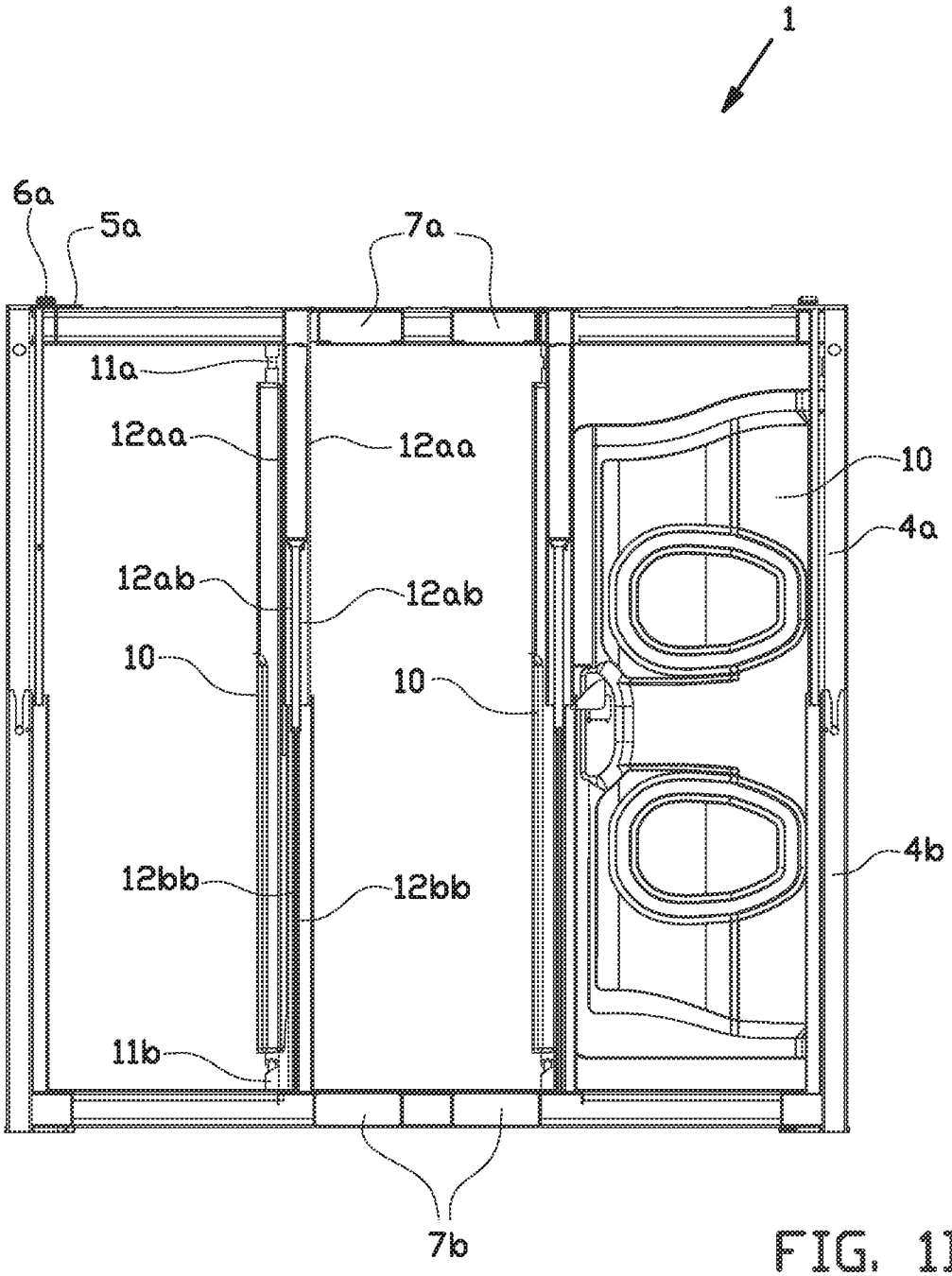
Figure 1E:
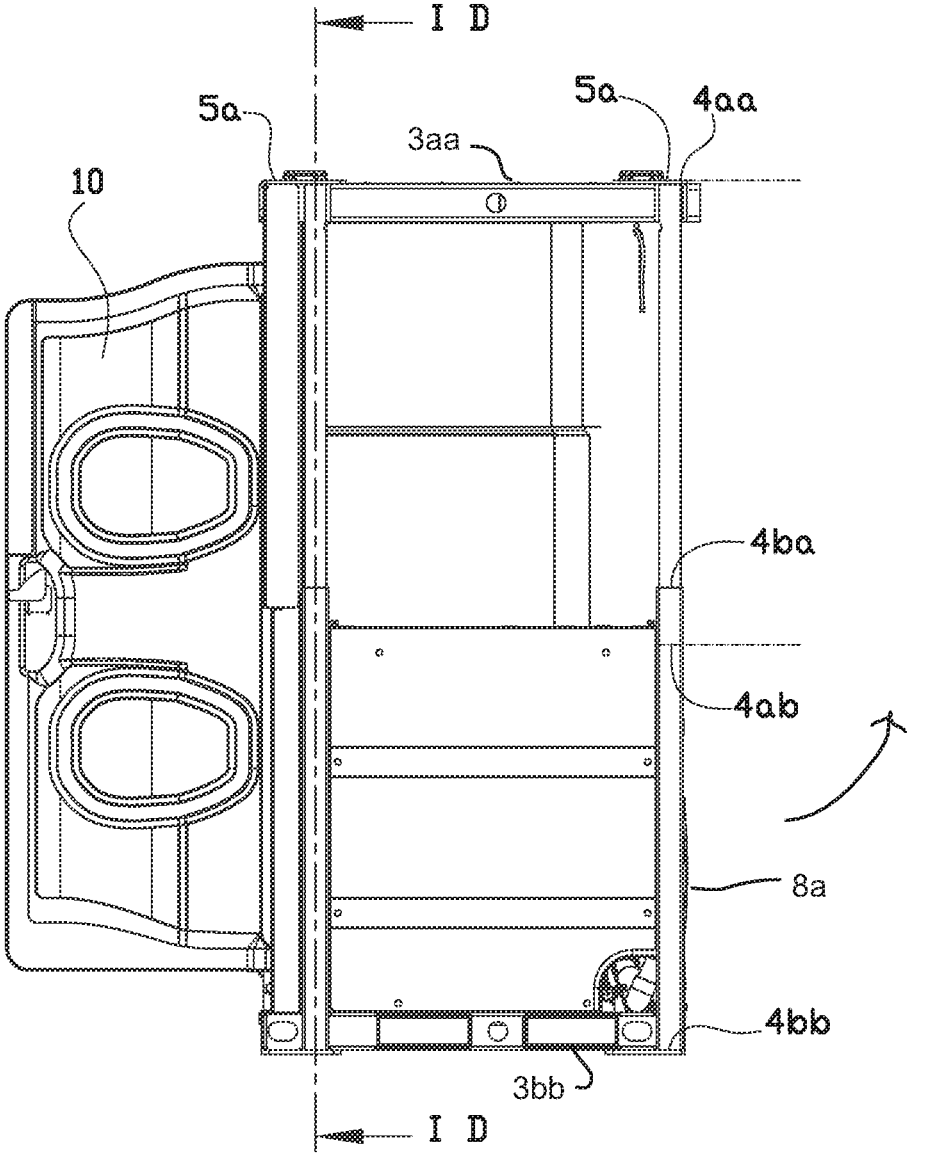

As can be seen, also see FIG. 1E, the columns 4 are situated slightly offset to the rear at the corners at the front side, whereas the columns 4 at the corners at the rear of the unit 1 are situated at the corner. As a consequence, there is room at the front side to place the hinge pins 11*a*, 11*b* at the left-hand side in front of the column 4*a,b* situated at that location. Room can also be left free at the right-hand side for abutment of the door 10 operational at that location. As a result, the overall horizontal occupation of space in the direction parallel to the front side can be kept within limits, for an equal number of subspaces.

As the column sections 4*a*,4*b* extend from a short distance (the thickness of the upper plate 20) from the upper plane 3*aa* of the upper cover 3*a* and from the lower plane 3*bb* of the bottom 3*b*, respectively, and are capable of being slid fully into each other, wherein the lower edge 4*ab* of the column sections 4*a* extends as far as the lower plane 3*bb* and the upper edge 4*ba* extends as far as said short distance from the upper plane 3*aa*, an as low as possible height in the transport position relative to the achievable height in the operational position is realized, namely almost equal to the height of a column section 4*a* or 4*b* (the thicknesses of the support plates 5*a,b* have to be added in the example). Also see FIG. 1E, in which it can be seen that only the upper edge 4*aa* of upper column section 4*a* is attached to the lower side of the support plate 5*a*, so that the upper edge 4*ba* of the lower column section 4*b* can extend as far as against the lower side of the support plate 5*a* in the transport position. The lower edge 4*ab* of the upper column section 4*a* then rests on the upper side of the support plate 5*b*.

Figure 3:
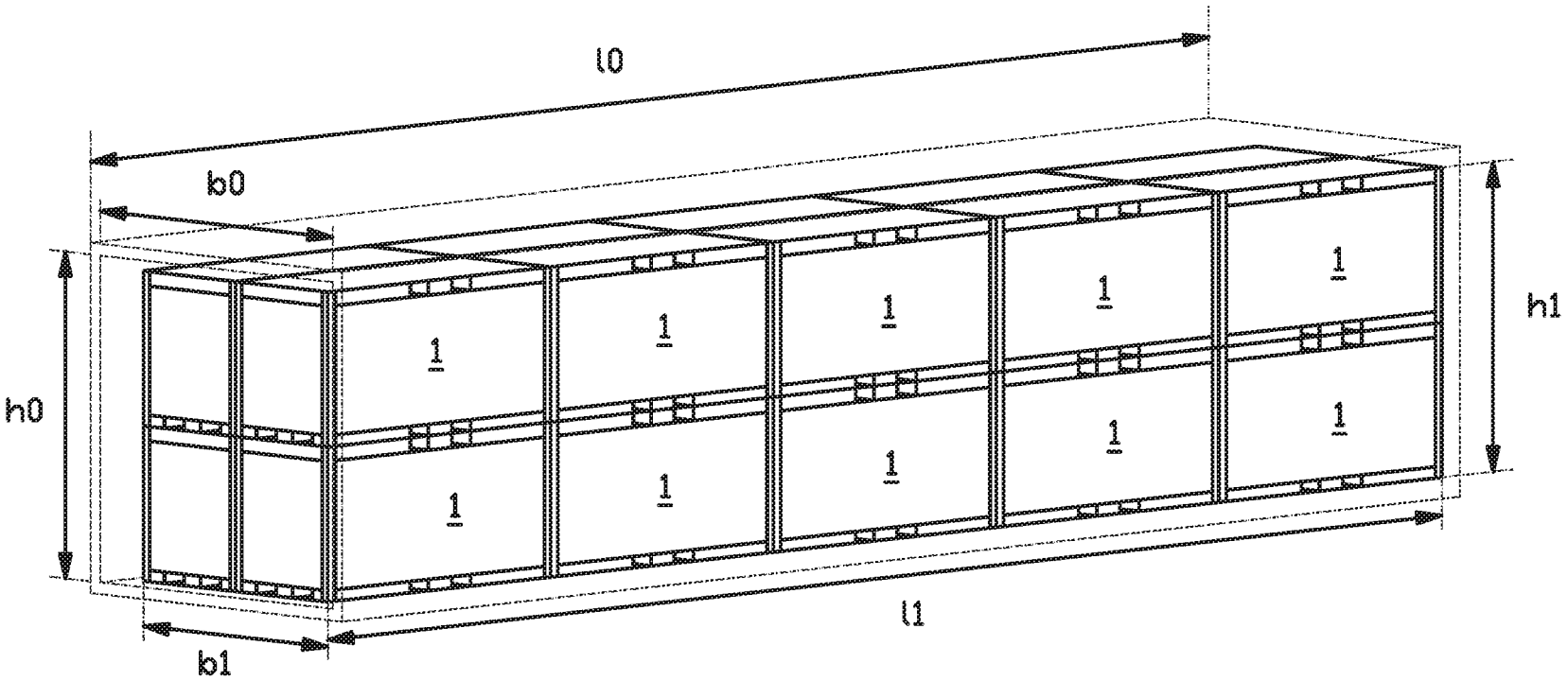
FIG. 3 shows a schematic view of a transport container having a number of sanitary units according to the invention in the transport position in there.

By way of example, in the transport position of the unit 1 (FIGS. 2A,B) the length L along the front side can be approximately 2.35 m, the width or depth B approximately 1.1 m and the height H approximately 1.3 m. FIG. 3 illustrates how 2× ten of such units can be accommodated in a 40 ft high cube container 100, of which the internal dimensions in the clear of the door opening are 2.33 m wide b0 by 2.655 m high h0, having a container length l0 of 11.998 m. The assembly of the twenty units 1 may then cover a length l1 of approximately 11.8 m, a width b1 of 2.2 m and a height of approximately 2.6 m, including the placement cams projecting at the upper side of the top units 1.

On the site where they will be used, a forklift truck can remove the sanitary units 1 one by one out of the container 100 and place them at the correct spot, wherein the fork engages into the holes 7*b* at the short side. Next, the fork of the same forklift truck can be inserted into the holes 7*a*, and subsequently, by raising the fork, the upper frame section 2*a* can be lifted relative to the lower frame section 2*b*. The upper columns sections 4*a* then slide out of the lower column sections 4*b*, until the operational height has been reached, which in this example, can amount to approximately 2.31 meters between the upper plane 3*aa* and the lower plane 3*bb*. The fork is then kept still and the driver or another person operates the blocking facility in the unit 1 for securing both column sections 4*a*,4*b* in that position. In this extension process the partition wall portions 12*aa* and 12*ab* have also been extended upwards along the inner side of the partition wall sections 12*b*. After flipping the back plate 8*a* open, the doors 10 can be taken out and placed at the front side on the pivot pins 11*a*,11*b*. The various pipes and cables can be connected.

When transporting the unit 1 away again, the pipes etc. are first disconnected. Then the doors 10 are placed in the space 17 again. The fork of a forklift truck is inserted in the holes 7*a* and the blocking facility is released. The fork is then lowered, wherein the upper column sections 4*a* slide into the lower column sections 4*b* again, until they have been fully accommodated in each other, wherein the upper edge of the lower column section 4*b* abuts the lower side of the support plate 5*a* and the lower edge of the upper column section 4*a* abuts the upper side of the support plate 5*b*. Simultaneously the partition wall portions 12*aa*,12*bb* have been retracted sliding along each other and along the inner side of the back wall section 12*b* again, wherein first the partition wall portion 12*ab* with its lower edge abuts for instance the upper/rear edge of the toilet bowl P or another abutment, and then the partition wall portion 12*aa* slides further downward along the inner side of the partition wall portion 12*ab*.

In the transport position that is now realized, the blocking facility can be used again for securing the column sections 4*a*,4*b* one to the other.

It is noted that the invention cannot only be applied to sanitary units with toilet bowls, but also to units with urinals, showers, wash basins and combinations thereof. A pump unit to be used with a number of sanitary units can be configured in a similar manner, with corresponding transport dimensions, for instance to be accommodated together with 19 sanitary units in the aforementioned 40 ft high cube container.

The invention is/inventions are not at all limited to the embodiments discussed in the description and shown in the drawings. The above description is included to illustrate the operation of preferred embodiments of the invention and not to limit the scope of the invention. Starting from the above explanation many variations that fall within the spirit and scope of the present invention will be evident to an expert. Variations of the parts described in the description and shown in the drawings are possible. They can be used individually in other embodiments of the invention(s). Parts of the various examples given can be combined together.

The invention claimed is:

1. A transportable sanitary unit, comprising:

a frame; and a number of sanitary facilities supported by the frame, wherein the frame comprises an upper section and a lower section, wherein the upper section comprises an upper cover and upper column sections extending downward from the upper cover, and the lower section comprises a bottom and lower column sections extending upward from the bottom, wherein the upper section and the lower section are movable relative to each other between an upwardly extended operational position having an operational height and a downwardly retracted transport position having a transport height that is lower than the operational height, wherein the upper column sections and the lower column sections are slidable into or along each other over a slide path between the operational position and the transport position, and in the operational position are securable one to the other in that position, wherein the upper cover and the bottom comprise construction members providing the upper cover with a first height and defines a first vertical space of the upper cover and the bottom with a second height and defines a second vertical space of the bottom, which each time defines a vertical space, and wherein, in the transport position, the lower column sections extend to within the first vertical space of the upper cover of the upper section and/or the upper column sections extend to within the second vertical space of the bottom of the lower section.

2. The sanitary unit according to claim 1, wherein the length of the lower column sections equals the length of the upper column sections.

3. The sanitary unit according to claim 1, wherein, in the transport position, the lower column sections extend to above half the first height of the upper cover, and/or wherein, in the transport position, the upper column sections extend to below half the second height of the bottom.

4. The sanitary unit according to claim 1, wherein the upper column sections and the lower column sections are slidable into each other between the operational position and the transport position.

5. The sanitary unit according to claim 4, wherein the upper cover has an upper plane, and wherein the upper column sections extend downward from a short distance from the upper plane of the upper cover.

6. The sanitary unit according to claim 4, wherein the bottom has a lower plane, and wherein the lower column sections extend upward from the lower plane of the bottom.

7. The sanitary unit according to claim 1, wherein the frame defines a box-shape, and wherein the upper column sections and the lower column sections are situated near corners of the frame.

8. The sanitary unit according to claim 7, wherein the frame defines a straight parallelepiped shape, wherein the upper cover has an upper plane and the bottom has a lower plane, the sanitary unit being provided with placement devices on the upper plane and on the lower plane, near the corners, provided with placement devices and accommodation holes suited to the placement devices, configured for stacking two or more identical sanitary units, wherein the placement devices are arranged on support plates, wherein the upper column sections and lower column sections are attached to the support plates, and wherein the placement devices are within the frame as viewed in a horizontal plane of projection on the sanitary unit.

9. The sanitary unit according to claim 8, wherein the upper column sections and lower column sections are situated offset relative to the placement devices.

10. The sanitary unit according to claim 8, wherein the upper column sections and the lower column sections are tubular and debouch in the respective support plates.

11. The sanitary unit according to claim 1, comprising three subspaces with toilet bowls, which subspaces are situated next to each other and accessible from the same access side.

12. The sanitary unit according to claim 1, having a height in transport position approximately, but less than half the internal height of a standard 40 ft high cube transport container, and having a width in the transport position at the access side approximately, but less than one fifth of the internal length of a standard 40 ft high cube container, and having a depth in the transport position at the transverse sides approximately, but less than half the internal width of a standard 40 ft high cube container.

13. A transport container having a number of first-type sanitary units according to claim 1 in an interior of the transport container, wherein the container is configured as a 40 ft high cube container, having 20 of the sanitary units of claim 1, in transport position in its interior;

wherein the sanitary units have a height in transport position approximately, but less than half the internal height of a standard 40 ft high cube transport container, and having a width in the transport position at the access side approximately, but less than one fifth of the internal length of a standard 40 ft high cube container, and having a depth in the transport position at the transverse sides approximately, but less than half the internal width of a standard 40 ft high cube container.

14. The sanitary unit according to claim 1, wherein, in the transport position, an uppermost portion of the lower column sections extend within a portion of the upper column sections located within the first vertical space of the upper cover of the upper section and/or a lowermost portion of the upper column sections extend within a portion of the lower column sections located in the second vertical space of the bottom of the lower section.

15. A sanitary unit comprising:

a frame; and a number of sanitary facilities supported by the frame, wherein the frame comprises an upper section and a lower section, wherein the frame defines a straight parallelepiped shape, wherein the upper section comprises an upper cover and upper column sections extending downward from the upper cover and the lower section comprises a bottom and lower column sections extending upward from the bottom, wherein the upper section and the lower section are movable relative to each other between an upwardly extended operational position having an operational height and a downwardly retracted transport position having a transport height that is lower than the operational height, wherein the upper column sections and the lower column sections are slidable into or along each other over a slide path between the operational position and the transport position, and in the operational position are securable one to the other in that position, wherein the frame defines a box-shape, and wherein the upper column sections and the lower column sections are situated near corners of the frame, wherein the unit has an access side and holding devices for doors at said access side, and wherein the lower column sections that are situated near corners at the access side, are situated offset in a direction away from the access side relative to the front edge of the bottom situated at the corners at the access side.

16. A sanitary unit comprising:

a frame; and a number of sanitary facilities supported by the frame, wherein the frame comprises an upper section and a lower section, wherein the upper section comprises an upper cover and upper column sections extending downward from the upper cover and the lower section comprises a bottom and lower column sections extending upward from the bottom, wherein the upper section and the lower section are movable relative to each other between an upwardly extended operational position having an operational height and a downwardly retracted transport position having a transport height that is lower than the operational height, wherein the upper column sections and the lower column sections are slidable into or along each other over a slide path between the operational position and the transport position, and in the operational position are securable one to the other in that position, wherein the unit comprises a number of sanitary subspaces that are situated next to each other, wherein the unit has an access side and holding devices for doors at said access side, wherein the subspaces are bounded by partition walls in horizontal directions in a direction away from the access side and/or towards one lateral side and/or towards both lateral sides, wherein the partition walls are divided into an upper partition wall section attached to the upper section, and a lower partition wall section attached to the lower section, wherein the upper partition wall section, considered from the interior of the subspace in question, during conversion from the transport position into the operational position and vice versa, are slidable vertically along the inner side of the lower partition wall section, wherein the upper partition wall section is divided in vertical direction into at least a first and a second partition wall portion, the second upper partition wall portion being located below the first upper partition wall portion, and wherein the first upper partition wall portion, considered from the interior of the subspace in question, during conversion from the transport position into the operational position and vice versa, are slidable vertically along the inner side of the second partition wall portion of the upper partition wall section.

17. The sanitary unit according to claim 16, wherein the sanitary facility in the subspaces is attached to the lower section.

18. The sanitary unit according to claim 17, wherein the upper partition wall section is divided in vertical direction into partition wall portions, wherein the upper partition wall portion, considered from the interior of the subspace in question, during conversion from the transport position into the operational position and vice versa, are slidable vertically along the inner side of the partition wall portion of the upper partition wall section situated below it, and wherein the upper partition wall portions are slidable downward along the lower partition wall section down to the location of attachment of the sanitary facility.

19. The sanitary unit according to claim 17, wherein the partition walls define a lying U-shape, wherein the opening of the U-shape is situated at the access side.

20. The sanitary unit according to claim 16, comprising three subspaces with toilet bowls, which subspaces are situated next to each other and accessible from the same access side.

* * * * *